United States Patent [19]

Wulz

[11] 4,297,770

[45] Nov. 3, 1981

[54] SLIDE FASTENER AND METHOD OF MAKING SAME

[75] Inventor: Helmut Wulz, Birmensdorf, Fed. Rep. of Germany

[73] Assignee: Optilon W. Erich Heilmann GmbH, Cham, Switzerland

[21] Appl. No.: 56,394

[22] Filed: Jul. 10, 1979

[30] Foreign Application Priority Data

Jul. 12, 1978 [DE] Fed. Rep. of Germany ..... 2830520
Jul. 12, 1978 [DE] Fed. Rep. of Germany ..... 2830521
Jul. 12, 1978 [DE] Fed. Rep. of Germany ..... 2830530

[51] Int. Cl.[3] ..... A44B 19/34

[52] U.S. Cl. ..... 24/205.16 R; 24/205.13 R; 24/205.1 R

[58] Field of Search ..... 24/205.13 R, 205.13 D, 24/205.16 R, 205.16 D

[56] References Cited

U.S. PATENT DOCUMENTS

| | | | |
|---|---|---|---|
| 2,380,623 | 7/1945 | Winterhalter | 24/205.16 R |
| 3,179,996 | 4/1965 | Clauss | 24/205.16 R X |
| 4,033,014 | 7/1977 | Manning | 24/205.16 R |
| 4,037,295 | 7/1977 | Rojahn | 24/205.16 R X |
| 4,080,691 | 3/1978 | Moertel | 24/205.16 R X |
| 4,140,157 | 2/1979 | Scott | 24/205.16 R X |
| 4,171,556 | 10/1979 | Moertel | 24/205.13 R |

FOREIGN PATENT DOCUMENTS

| | | | |
|---|---|---|---|
| 2722054 | 5/1976 | Fed. Rep. of Germany | 24/205.13 R |
| 2741780 | 9/1976 | Fed. Rep. of Germany | 24/205.13 R |

*Primary Examiner*—Roy D. Frazier
*Assistant Examiner*—Peter A. Aschenbrenner
*Attorney, Agent, or Firm*—Karl F. Ross

[57] ABSTRACT

A slide fastener comprising a pair of tapes and respective rows of slide-fastener elements individually secured to the tapes. The slide-fastener elements are each bent over an edge of the tape and welded together thermally or ultrasonically. The arms of the fastener elements are formed along their lateral surfaces or sides with grooves of increasing depth toward the respective tape and weft yarns, interwoven with the warp of the tape, are provided along the edge and are disposed in the grooves to provide torsional stability for the individual coupling elements.

17 Claims, 12 Drawing Figures

SLIDE FASTENER AND METHOD OF MAKING SAME

FIELD OF THE INVENTION

The present invention relates to a slide fastener having woven tapes and, more particularly, to a slide fastener comprising a pair of tapes along the juxtaposed edges of which are provided respective rows of individual coupling elements of thermoplastic synthetic resin.

BACKGROUND OF THE INVENTION

Slide-fastener stringers have been made heretofore with a pair of woven support tapes along juxtaposed edges of which are provided respective rows of spaced apart discrete or individual coupling elements of thermoplastic synthetic-resin material. The coupling elements can have arms which are clamped over the edge of the support tape and are joined together in a weld zone, a continuous support member, or plurality of such support members, extending along the row of coupling elements and, generally, forming part of the support tape. Weft yarns of the tape may pass over this continuous support member between adjacent fastener elements.

The fastener elements may also have coupling heads which interdigitate with the coupling heads of the other row upon movement of a slider along the stringer, the slider also serving to disengage the rows of coupling heads from one another.

The coupling elements of slide fasteners of this type generally are symmetrical with respect to the plane of the fastener. They can be shaped by bending initially substantially flat members into a U-shape so that the bight of the U forms the coupling head and the shanks of the U form the aforementioned arms.

The tapes may be composed of weft and warp yarns in a conventional manner and all of the weft yarns or only some of them can reach over the support member, which can also be a warp yarn, a cord or the like, to serve as attachment weft yarns. The support member can, as just noted, be a single-strand core engaged between the arms of the coupling element or disposed in a loop between the bight and the fusion point or zone. The support member can also consist of two or four or more so-called rope-ladder yarns which are embedded in the shanks of the fastener elements so as to be considered a multistrand support.

In all of the cases stated, the term "support" is intended to refer to single strand and multistrand, monofilament or multifilament, braided or other composite member which is disposed in the plane of symmetry of the coupling members or elements.

In general, however, the support will be a textile member which can be dimensioned and designed to withstand the transverse pull experienced by the finished fastener.

With slide fasteners of the type with which the present invention is concerned, several stress directions may be considered. The transverse direction mentioned previously is, of course, a direction transverse to the slide-fastener axis, i.e. perpendicular to the rows, usually in the slide-fastener plane. It is also important to consider the torsional stresses which act upon the discrete slide-fastener elements and tend to pivot them around the support, i.e. around the axis of the slide-fastener row, relative to the plane of the fastener. Torsional stress of this type can be considered to result from a force applied perpendicular to the plane of the slide fastener at the head of each coupling element and in a direction tending to twist the latter about the support.

The slide fastener is also exposed to various bending stresses, i.e. stresses applied transversely to the plane of the slide fastener in mounting the latter upon a garment, for example, or in use, a longitudinal stress during use of the slide fastener also being experienced.

In discrete-element slide fasteners (see German patent document No. 2,722,054) it is difficult to ensure torsional stability of the discrete fastener elements about the support and therefore relative to the plane of the fastener. To achieve this torsional stability it is known to form on the individual coupling elements thermoplastic members which extend longitudinally of the fastener or which may even be continuous to connect the coupling elements together. These thermoplastic members provide torsional stability either alone or in combination with the associated support member (see German patent document No. 2,741,780).

Unfortunately, with the latter technique for avoiding torsional distortion and increasing torsional stability, the fastener as a whole has an increased rigidity in that it cannot be as readily bent in or out of the fastener plane. The increased rigidity considerably reduces the break open strength of the closed slide fastener. This is because the stiffening elements produce stress and opening forces.

OBJECTS OF THE INVENTION

It is the principal object of the present invention to provide an improved slide fastener whereby the aforementioned disadvantages are obviated.

Another object of the invention is to provide a slide fastener having discrete, i.e. individual, coupling elements, wherein the elements are stable with respect to torsion without detrimentally increasing the rigidity of the slide fastener.

Yet another object of the invention is to provide an improved method of making a slide fastener.

SUMMARY OF THE INVENTION

These objects and others which will become apparent hereinafter are attained, in accordance with the present invention, in a slide fastener of the type described, i.e. a slide-fastener stringer having a pair of woven tapes along juxtaposed edges of which rows of individual (discrete) coupling elements are provided, each of the coupling elements being bent into a U-configuration and having its arms straddling the plane of the respective support tape and being bonded together within the edge of the support tape at a weld zone by thermal or ultrasonic welding. A single strand or multistrand support is provided along each edge and is engaged by the coupling elements.

According to the invention, this type of slide fastener can be improved by providing the arms of each coupling element along their lateral surfaces with grooves of increasing depth toward the respective tape, attachment weft yarns, which pass over the elongated support, being disposed in these grooves.

The fitting of the weft yarns within the lateral grooves of the coupling elements makes it possible to establish for each of the coupling elements a pivot point ensuring that the bending of the coupling element in or out of the fastener plane does not cause disturbing opening forces and strains.

In a preferred embodiment of the invention, the attachment weft yarns form a pivot pad in the zone in which they engage over the support member and fan out in the region of the grooves and within the latter, the pivot pad helping to stabilize the separation between the individual coupling elements. In other words, the weft yarns are provided in laterally adjacent contacting relationship in a highly compact manner between the coupling elements where these weft threads pass over the support and then, while reaching back to the body of the tape, fan out from one another, at least partly extending into the grooves of the coupling elements to define the pivot axes.

The number and thickness of the attachment weft yarns are such that they form a bearing pad in the zone where they engage over the support members so that the gap between adjacent fastener elements is determined practically precisely by the number and thickness of the weft yarn and cannot be reduced by any movement of the coupling members toward one another. However, when the attachment weft yarns fan out near the grooves in the manner described, the pads do not have a stiffening effect but serve as rocker bodies for the coupling members.

According to a further feature of the invention, at the end faces of the arms toward the tape, the coupling elements are formed with a groove receiving at least one longitudinally extending warp yarn. The side wall grooves and the end face grooves then act together to stabilize the individual coupling elements against torsion.

Clearly defined relationships in the bending of a coupling member in and out of the fastener plane are created by the system in the present invention, especially if at least some of the attachment weft yarns cross over or under the warp yarns between adjacent fastener elements and the warp yarns and weft yarns cross over and under, i.e. are cross woven, at least in the end face grooves.

In the preferred embodiment of the invention, moreover, the coupling element of the slide-fastener stringer are disposed symmetrically with respect to a plane parallel to the slide-fastener plane and in a plane perpendicular to the slide-fastener plane and extending perpendicular to the longitudinal axis of the slide fastener and centrally through the coupling member.

The side wall groove, the end face groove and the support can all be disposed in the plane of symmetry which lies parallel to the slide fastener plane or which coincides therewith.

One of the important advantages of the present invention is that the slide fastener described previously can be produced without material modification of the machinery hitherto used, once the coupling members are properly formed, and can use conventional technology in the production of the tapes.

According to still another feature of the invention, the support is an elongated cord or core which can itself serve as a torsion-resistance support member and which can be of oval or rectangular cross section. The coupling members can be so secured by their arms to the support member so as to be resistant to torsion and stable against their separation from one another. The torsion-resistant support can be so attached to the tape between adjacent coupling members as to be resistant to torsion. Preferably the coupling members are positively engaged with their support.

The terms "stress-resistant" and "torsion-resistant" may be used herein and are intended to refer to a resistance to stretching and torsion which is sufficient for the purposes of the invention, i.e. to prevent undesired opening of the slide fastener or stiffening thereof. It is not necessary that stretch and twisting be completely excluded. The torsion-resistant support is generally a textile member as mentioned above and, indeed, can be a single member or a number of members. According to the invention, the arms of the coupling members can be additionally connected to the torsion-resistant support by welding.

The textile support can be a core which is woven, braided or in the form of lace, or simple a bundle of yarns or threads.

In general, when a textile core or cord is used, the coupling elements are free to pivot relative to one another and to the fastener plane around this core. However, according to the present invention, the coupling elements are so secured to the core that they are engaged therewith so that relative pivoting of the core and the coupling element is impermissible.

The support core should be stretch resistant and relatively incompressible to provide adequate stabilization of the separation between the coupling members. This can apply to textile supports which have already been given a preliminary upsetting by the attachment of the coupling members to them, this preliminary upsetting assisting stabilization of the type described.

According to another feature of the invention, the arms of the coupling elements may have projections, protuberances or other formations for positive engagement within the support core.

According to yet another feature of the invention, which makes it possible to provide a more definitive relationship between the coupling members and the support and which makes it possible to observe close manufacturing tolerances, the space between the arms of the coupling members is chambered to receive the torsion-resistant support, the chambering merging into the weld zone.

In addition or alternatively, the weld zone can be subdivided into a number of weld portions between which recesses are provided to receive one or more strands forming the support. The support members are therefore disposed in the plane of symmetry of the coupling members and therefore in the fastener plane.

According to yet another feature of the invention one or more support members are embedded in the arm or projections thereof in the weld zone. Projections can be so provided that they form steps which are staggered relative to one another so that the embedded auxiliary support members and the torsion-resistant support member are disposed in the plane of symmetry of the fastener elements as well.

According to still another feature of the invention, a special auxiliary support member can be provided on the side near the tape and can be received in the groove. The torsion-resistant support can have a section modulus designed to enable it to receive and resist torsional stress or can be formed from a number of strands to the same effect.

The textile cores and tapes are preferably constituted of synthetic resin yarns, preferably of a thermoplastic monofilament or polyfilament which can be thermally set or ultrasonically or thermally fused to the thermoplastic coupling member.

Another aspect of the invention resides in the technique used for stabilizing the slide fasteners constructed in the manner described. When the slide fastener has torsion-resistant support members comprising synthetic yarns, the coupling members are secured to the torsion-resistant support members by thermal action, e.g. thermosetting of the associated support member and, where applicable the or each auxiliary support member. Where the weft yarns engage over the torsion-resistant support member the latter is attached to the tape by thermosetting of the weft yarns of the tape.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
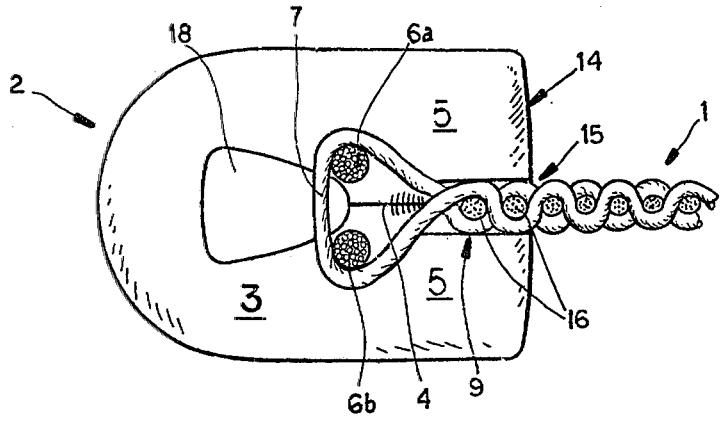
FIG. 2 is a section take along the line II—II of FIG. 1 but illustrating a modification thereof.

The slide fastener of the present invention has woven tapes 1 and rows 2 of discrete coupling members attached to the tape 1. The discrete coupling members 3 are composed of synthetic-resin material, preferably thermoplastics, and are of a loop configuration, i.e. having a bight forming the coupling head and a pair of arms which straddle the slide-fastener plane.

The V-shaped coupling members 3 have arms 5 joined together in a weld zone 4 and are combined to form a row 2 by a continuous single-strand or multi-strand support 6. The weld may be formed by any conventional technique, e.g. solvent, thermal or ultrasonic bonding.

Attachment weft yarns 7 of the associated tape 1 engage over the support member 6 between adjacent elements 3. As can be gathered more particularly from FIG. 1, the arms 5 are formed on their lateral surfaces 8 with grooves 9 whose depth T increases towards the associated tape 1. The yarns 7 which are at the edge are received in the side wall grooves 9.

In the embodiment shown, and as is preferred for the purposes of the invention, the yarns 7 form in the zone where they engage over the support members 6 a pad 11 which stabilizes the separation between the individual coupling elements 3.

Figure 1:
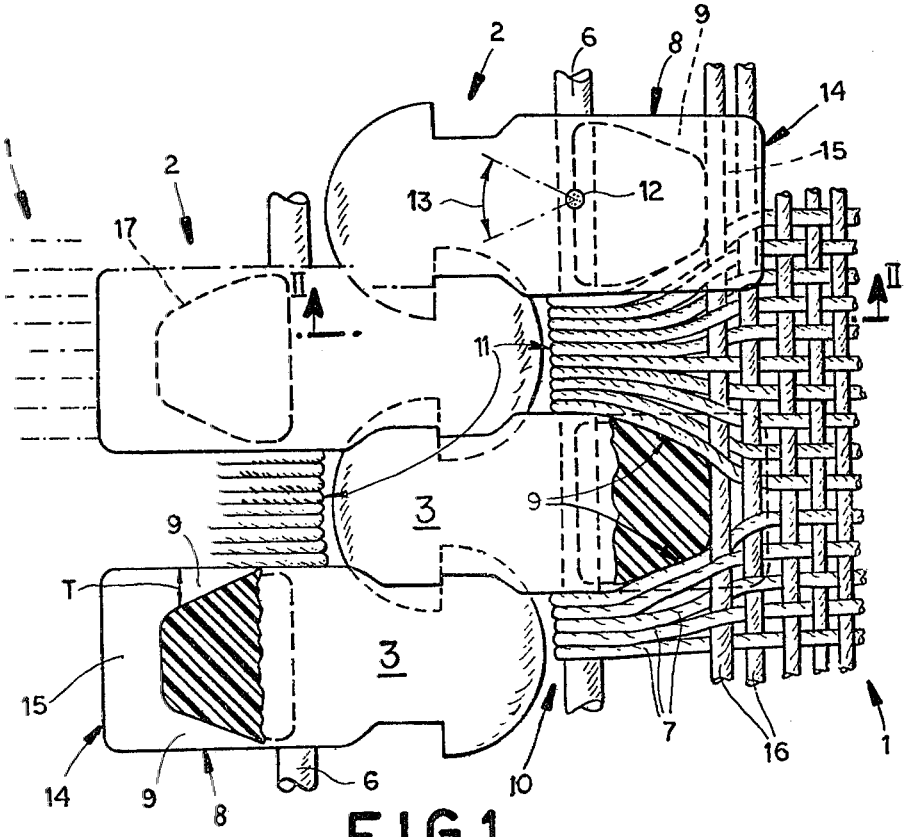
FIG. 1 is a diagrammatic plan view showing a portion of a slide fastener according to the invention, partly broken away along the slide-fastener plane.

The pad 11 has a pivot effect because the yarns 7 fan out from the grooves 9, and the elements 3 are pivotable around the resulting imaginary pivot points 12 in the manner indicated by a double arrow 13 in FIG. 1.

The coupling elements 3 shown in all of FIGS. 1 to 6 and 11 are of the kind whose endface 14 associated with the tape 1 is formed with an additional groove 15 (endface groove) which receives at least one longitudinally extending warp yarn 16 of the tape 1. In the preferred embodiment of FIG. 1 at least some of the yarns 7 extend crosswoven between adjacent coupling elements 3; consequently, the warp yarns 16 in the endface grooves 15 extend crosswoven between adjacent elements 3.

The discrete elements 3 (FIG. 1) are symmetrical with respect to the fastener plane. The grooves 9, 15 and the support member 6 are disposed in the latter plane of symmetry.

Figure 6:
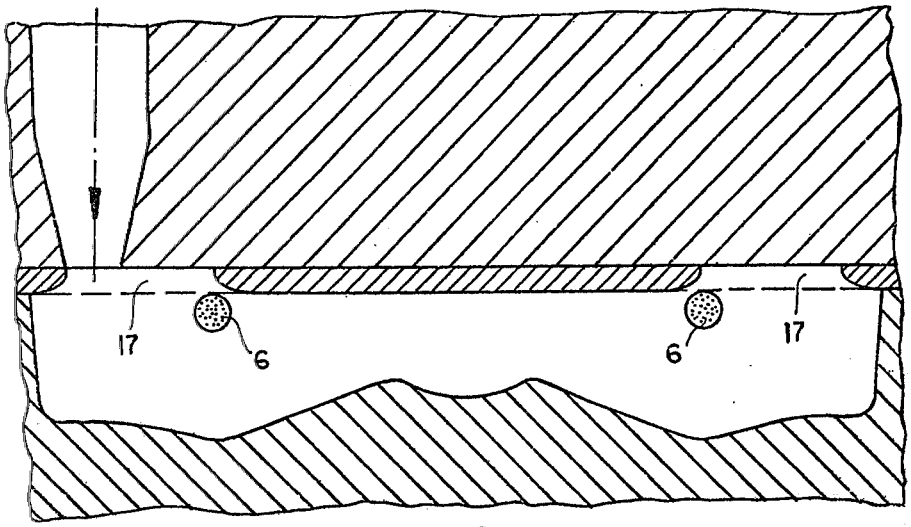
FIGS. 5 and 6 are, respectively, a bottom plan view and a cross section through a mold used for producing the coupling members of the present invention.
Figure 5:
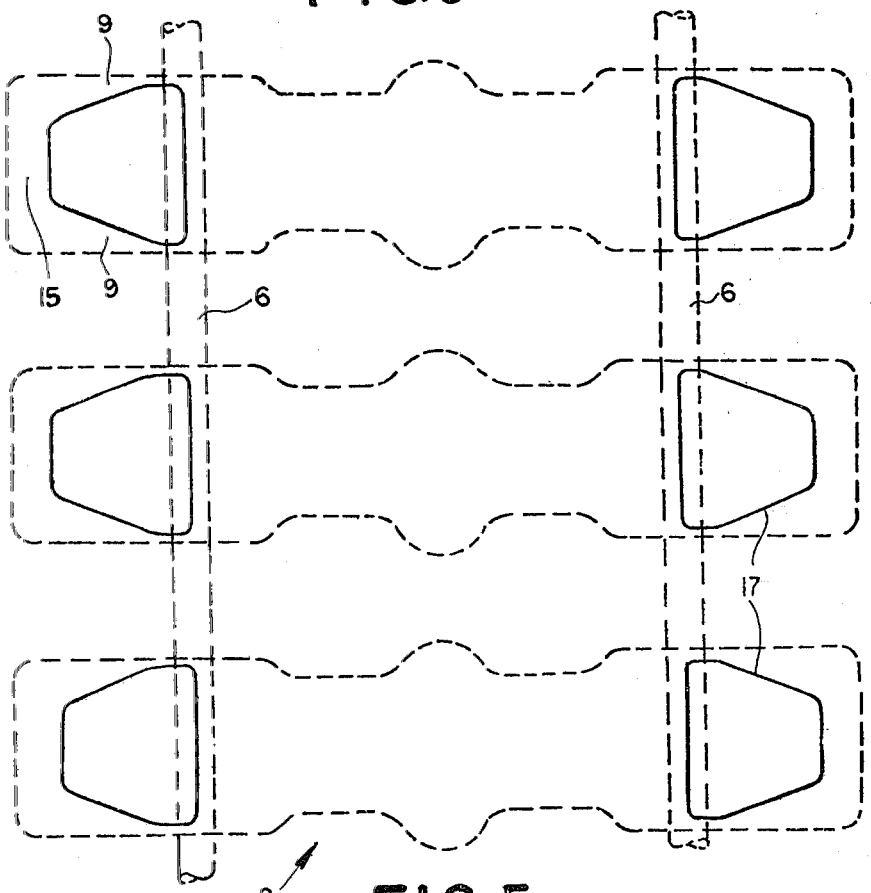

As can be gathered from the mold shown in FIGS. 5 and 6, production of the rows 2 of slide fasteners according to the invention starts with the injection molding of flat blanks having protuberances 17 which are first bent into a U shape, then welded together by means of tools which are not shown to form the weld zones 4. Since the protuberances 17 are narrower than the arms 5 of the elements 3, the side wall grooves 9 are produced during the welding step. Since the protuberances 17 are shorter than the arms 5, the additional endface grooves 15 also are produced.

FIG. 2 shows an embodiment of a slide fastener according to the invention in which the support is embodied as two strands **6*a*, 6*b* which are in the form of a rope ladder and which are disposed in the arms 5**.

Figure 3:
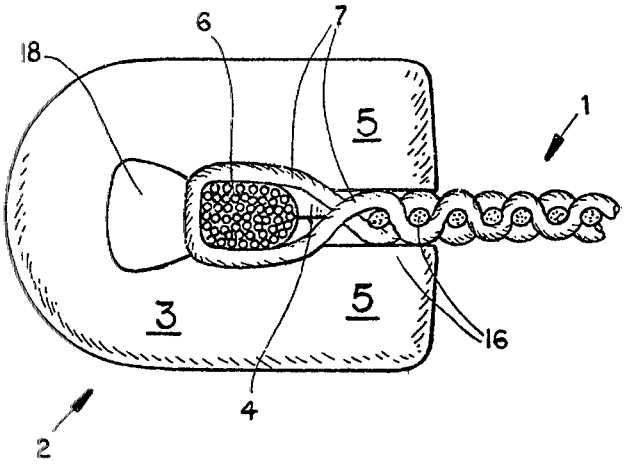
FIG. 3 is a view similar to FIG. 2 but illustrating still another embodiment of the slide fastener according to the invention.

FIG. 3, however, shows an embodiment having a single-strand support member 6. The same forms a core which is disposed in the loop 18 of the coupling elements 3 and which can be torsion-resistant to the extent necessary for the torsional stability of the complete fastener.

Figure 4:
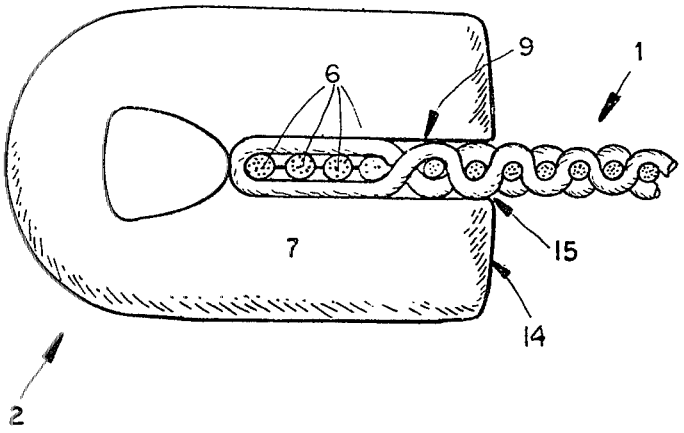
FIG. 4 is another view similar to FIG. 3 of a further embodiment.

In the embodiment shown in FIG. 4 a total of four strands are disposed in the plane of symmetry of the elements 3 and together make up the support member 6. In all the cases hereinbefore described the strands are textile strands.

In the portion of slide fastener shown in FIG. 2, each coupling element 3 has a coupling or end head 19, two arms 5 and the loop 18 which is associated with the bight at the coupling end 19 of the associated element 3 of the other half of the fastener to give a positive interengagement of the rows in the coupled-together state. For the rest, the rows 2 have a continuous support member 6 which is received in the loop space 20 of the elements 3 and which for the purposes of the invention is preferably a textile core.

Figure 7:
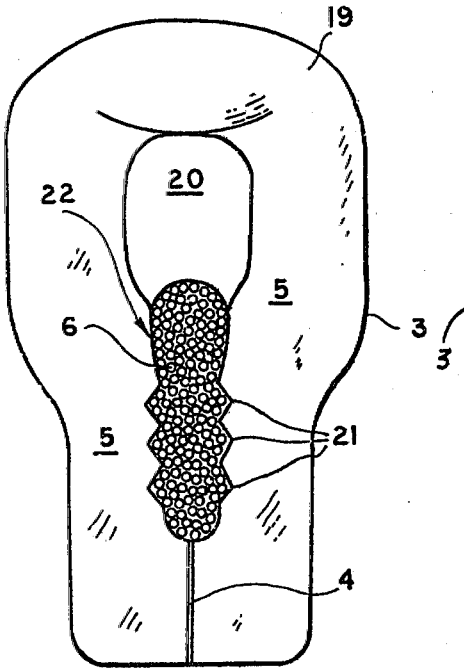
FIGS. 7–12 are views similar to FIG. 3 but with a different orientation in FIGS. 7–10 showing other embodiments of coupling members for a slide fastener according to the invention.

To stabilize the separation between the discrete coupling elements 3 and to secure the same torsionally, the coupling elements 3 of the embodiment shown in FIG. 7 have on the arms 5 positive-engagement means (e.g. formations) 21 which are pressed into the member 6. In the embodiment shown in FIGS. 7 and 8, the space 20 of the elements 3 has chambering 22 which receives the support member 6 and which merges into the weld zone 4. As can be seen in FIG. 7, the chambering 22 has the corrugated or sawtooth formations 21 for positive engagement.

Figure 8:
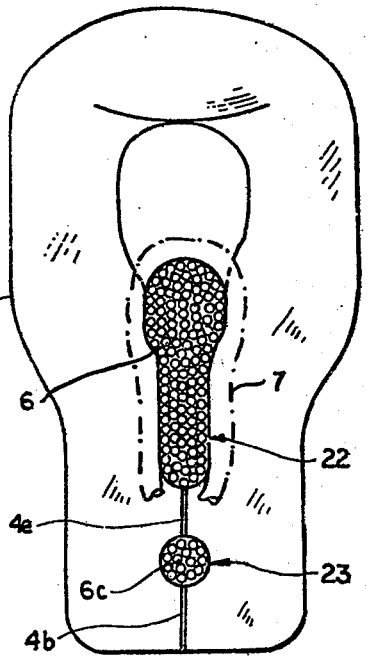
Figure 9:
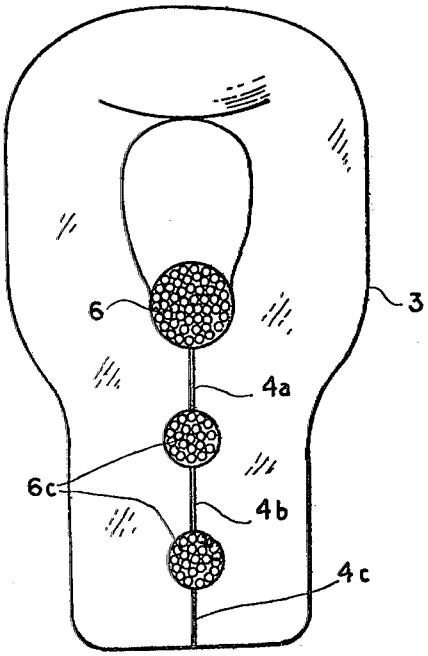

In the embodiment shown in FIGS. 8 and 9 the weld zone is subdivided into a number of portions **4*a*, 4*b*, 4*c* between which there are recesses 23 for one or more strands 6*c***.

Figure 10:
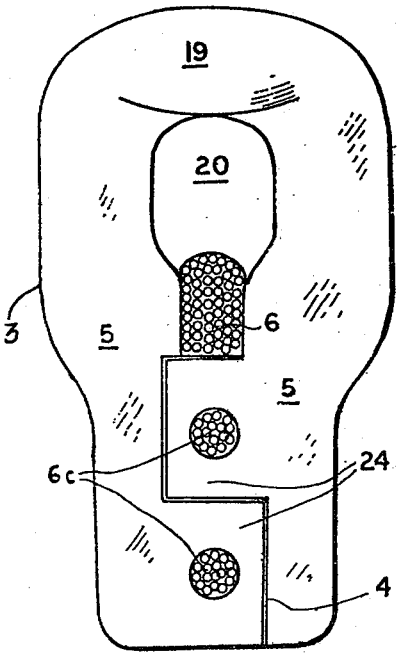

In the embodiment shown in FIG. 10 the strands **6*c* engage in projections or steps 24 which are formed on the arms 5** and which are staggered relatively to one another.

In all the embodiments shown in FIGS. 7 to 10, both the support member 6 and any additional strands **6*c* are disposed in the plane of symmetry of the various fastener elements 3 which are of correspondingly symmetrical construction. This makes it readily possible to proceed as hereinbefore described and attach the rows 2 to their associated tape 1 in a manner resistant to torsion when the yarns 7 are looped tightly around the member 6 and also the strands 6***c*.

A comparison of FIGS. 7 to 10 will show that if members 6 having synthetic yarns are used, the fastener elements 3 can be secured very effectively to the member 6 by thermosetting (shrinkage) of the associated member 6 and, where applicable, of the or each strand 6*c*. If the tapes 1 used have synthetic yarns 7 engaging around the associated member 6 and, where applicable, the strands 6*c*, the thermosetting (shrinkage) of the yarns 7 can also be used to provide a very satisfactory torsion-resistant attachment.

Figure 11:
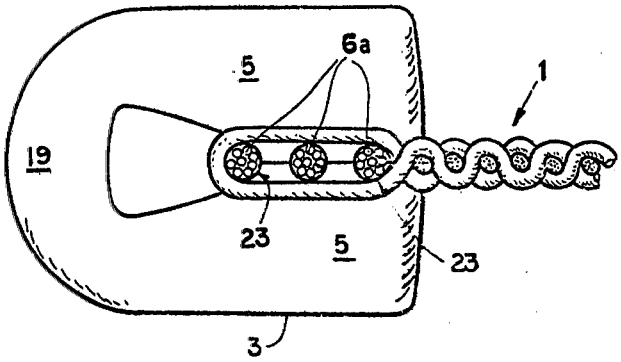

FIG. 11 shows a portion of a slide fastener according to the invention in which the support member 6 takes the form of a single-layer member comprising three strands 6*a*, one of which also serves as a core. In this embodiment the strands 6*a* are disposed in recesses 23 on the inside of the arms of the elements 3 and can be welded in the recesses 23.

Figure 12:
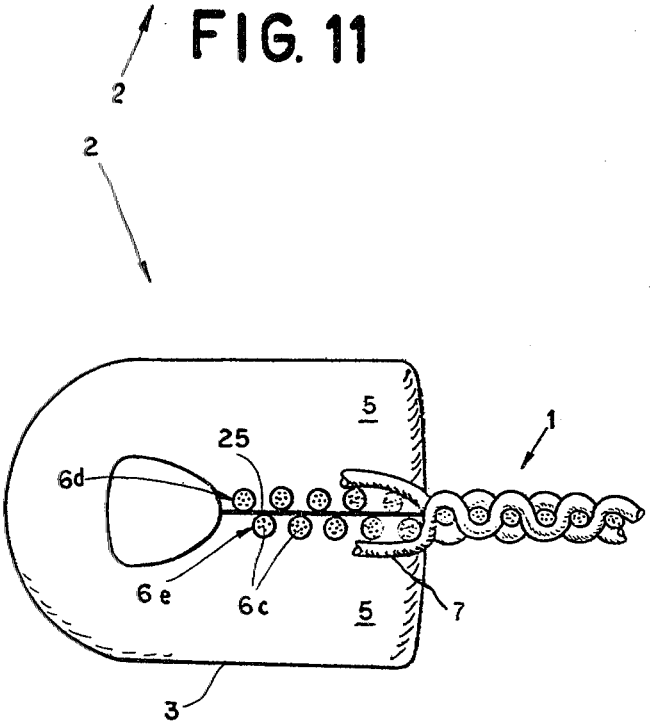

In the embodiment shown in FIG. 12, the strands form a two-layer torsion-resistant support member 6*d*, 6*e*. The strands of one layer 6*d* are received in recesses 23 on the inside of one arm 5. The strands of the other layer 6*e* are received in recesses 23 on the inside of the other arm 5. The strands are staggered relatively to one another in the two layers 6*d*, 6*e*. In this embodiment too the strands can be welded to the arms in the recesses 23, and the same can be foremed by a welding step.

The embodiment shown in FIG. 11 shows clearly the details of a slide fastener according to the invention wherein the strands 6*a* are introduced subsequently into the recesses 23. In the embodiment shown in FIG. 12, the strands are embedded in the associated arms 5 during the extruding or molding step; also, the strands 6 are covered by the adjacent arm 5 or by an applied synthetic-resin covering.

In any case the arms 5 of the elements 3 are welded together in the region of the strands 6*a*. The welding can be performed in the zone between adjacent strands or can be carried out by integration of the arms 5 in the weld seam. In such cases the strands are often surrounded with synthetic-resin projections near the weld zones and such projections act additionally and in interaction with tape elements as torsion abutments.

I claim:

1. A slide fastener comprising a pair of woven support tapes having juxtaposed edges, respective rows of coupling elements affixed to said edges and spaced apart therealong, the coupling elements of one row being interdigitatable with the coupling elements of the other row, each of said coupling elements having a head engageable between two coupling elements of the other row and a pair of arms reaching back toward the respective tape and joined together in a weld zone at the respective tape, and a respective continuous support extending along each row and engaged by the coupling elements thereof, each of said tapes having weft yarns extending over the respective support between the coupling elements, each of said coupling elements being formed with lateral grooves with a depth increasing toward the respective tape and receiving said weft yarn.

2. The slide fastener defined in claim 1 wherein said weft yarns between each two coupling elements of a respective row form a pivot pad completely filling the space between them where said weft yarns pass over said support and fan out in the region of said grooves.

3. The slide fastener defined in claim 2 wherein each of said coupling elements is formed at an end turned toward the respective tape with an end groove receiving a warp yarn of the respective tape.

4. The slide fastener defined in claim 3 wherein at least some of said weft yarns are crosswoven with the warp yarn in the region of said grooves.

5. The slide fastener defined in claim 2, claim 3 or claim 4 wherein said support is a single core of elongated cross-section straddled by the arms of the coupling elements of the respective row and secured to said arms so as to resist relative rotation of the coupling elements and the core, said core being attached to the respective tape between the coupling elements thereof so as to be resistant to torsion.

6. The slide fastener defined in claim 1, claim 2, claim 3 or claim 4 wherein said coupling elements are symmetrical about a plane parallel to the slide fastener plane and said grooves lie in the symmetry plane.

7. The slide fastener defined in claim 1, wherein said support is a single core of elongated cross-section straddled by the arms of the coupling elements of the respective row and secured to said arms so as to resist relative rotation of the coupling elements and the core, said core being attached to the respective tape between the coupling elements thereof so as to be resistant to torsion.

8. The slide fastener defined in claim 7 wherein each of said coupling elements is provided with formations positively engaging the respective core.

9. The slide fastener defined in claim 7, further comprising chambering formed in a bight of the respective coupling elements for receiving said core.

10. The slide fastener defined in claim 7 wherein said weld zone is subdivided into a plurality of portions defining recesses between them, said support additionally including strands extending continuously along the respective row and received in said recesses.

11. The slide fastener defined in claim 1, claim 2, claim 3 or claim 4 wherein said support comprises a pair of strands extending continuously along the respective row and embedded in corresponding arms of said coupling elements.

12. The slide fastener defined in claim 1, claim 2, claim 3 or claim 4 wherein each support comprises a plurality of support members each forming a two-layer torsion-resistant arrangement with the support members of one layer being disposed in recesses formed on the insides of one arm each of the coupling elements of the respective row and the support member of the second layer being disposed in recesses formed on the inside of each other arm of the respective coupling elements, the recesses in the two arms of each coupling member being staggered relative to one another.

13. The slide fastener defined in claim 1, claim 2, claim 3 or claim 4 wherein the support includes a member embedded in at least one of said arms and provided with a synthetic-resin coating.

14. The slide fastener defined in claim 1, claim 2, claim 3 or claim 4 wherein the support member is disposed in a projection on the respective coupling element.

15. A method of stabilizing a slide fastener as defined in claim 7 wherein each coupling element is secured to the core by thermosetting thereof.

16. A method of stabilizing a slide fastener as defined in claim 1, claim 2, claim 3 or claim 4 which comprises forming the weft yarns of a synthetic-resin material and thermosetting the weft yarns.

17. A method of making a slide fastener as defined in claim 1, claim 2, claim 3 or claim 4 which comprises molding a plurality of elongated coupling-element blanks around a pair of support-member strands located close to the ends of said blanks;

applying the resulting molded structure along an edge of a respective woven support tape by bending each of said blanks into a U configuration with the ends straddling a warp of the respective tape;

passing weft yarns around said support strands to completely fill the distance between the blanks, thereby anchoring same to the respective tape; and welding the ends of each blank together to constitute of each blank a respective coupling element.

* * * * *